US008561819B1

(12) United States Patent
Scott

(10) Patent No.: US 8,561,819 B1
(45) Date of Patent: Oct. 22, 2013

(54) STAND FOR HOLDING CLOTHING ACCESSORIES

(76) Inventor: Johnny L. Scott, Houston, TX (US)

( * ) Notice: Subject to any disclaimer, the term of this patent is extended or adjusted under 35 U.S.C. 154(b) by 350 days.

(21) Appl. No.: 12/838,143

(22) Filed: Jul. 16, 2010

(51) Int. Cl.

| | |
|---|---|
| *A47F 7/22* | (2006.01) |
| *A47F 7/19* | (2006.01) |
| *A47F 7/24* | (2006.01) |
| *A47F 5/13* | (2006.01) |
| *A47G 25/74* | (2006.01) |

(52) U.S. Cl.
USPC ..... 211/85.3; 211/206

(58) Field of Classification Search
USPC ..... 211/85.3, 36, 38, 34, 134, 41.6, 41.3, 211/59.2, 13.1, 44, 45, 204, 206, 10, 183; 108/180, 181, 187, 193; 312/265.1–265.4
See application file for complete search history.

(56) References Cited

U.S. PATENT DOCUMENTS

| | | | | | |
|---|---|---|---|---|---|
| 870,993 | A | * | 11/1907 | Richardson | 211/36 |
| 1,710,940 | A | * | 4/1929 | Murphy | 211/36 |
| D179,459 | S | * | 12/1956 | Potts | D34/20 |
| 2,966,991 | A | * | 1/1961 | Duffner | 211/60.1 |
| 3,064,992 | A | * | 11/1962 | Hoof | 280/79.3 |
| 3,358,847 | A | * | 12/1967 | Magnuson | 211/189 |
| 3,472,387 | A | * | 10/1969 | Olsen | 211/45 |
| 4,958,841 | A | * | 9/1990 | Keen | 280/47.35 |
| 5,542,758 | A | * | 8/1996 | Brown | 312/249.2 |
| 5,542,785 | A | | 8/1996 | Cloud | |
| 5,555,640 | A | * | 9/1996 | Ou | 34/202 |
| 5,797,503 | A | * | 8/1998 | Stevens et al. | 211/187 |
| 6,073,783 | A | * | 6/2000 | Allman | 211/85.3 |
| 6,102,216 | A | | 8/2000 | Frank | |
| 6,478,169 | B2 | * | 11/2002 | Krusell | 211/85.7 |
| 6,749,073 | B2 | | 6/2004 | McNab | |
| 6,991,118 | B2 | | 1/2006 | Phillips | |
| 7,249,680 | B2 | * | 7/2007 | Wang | 211/37 |
| 7,770,743 | B1 | * | 8/2010 | Janowak et al. | 211/119.12 |
| 7,832,571 | B2 | * | 11/2010 | Felsenthal | 211/134 |
| 2002/0027114 | A1 | * | 3/2002 | Krusell | 211/85.7 |
| 2002/0179551 | A1 | * | 12/2002 | Madela | 211/41.3 |
| 2003/0042826 | A1 | * | 3/2003 | Felsenthal | 312/237 |
| 2003/0192841 | A1 | * | 10/2003 | Shumate | 211/85.3 |
| 2004/0256341 | A1 | * | 12/2004 | Donnell et al. | 211/187 |
| 2005/0133470 | A1 | * | 6/2005 | Kin et al. | 211/45 |
| 2007/0051686 | A1 | * | 3/2007 | Sausman | 211/85.3 |
| 2008/0017597 | A1 | * | 1/2008 | Branch | 211/44 |
| 2008/0073300 | A1 | * | 3/2008 | Abraitis | 211/36 |
| 2008/0073302 | A1 | * | 3/2008 | Li | 211/134 |
| 2009/0145869 | A1 | * | 6/2009 | Battaglia | 211/153 |
| 2011/0204005 | A1 | * | 8/2011 | Freitas | 211/4 |

* cited by examiner

*Primary Examiner* — Jennifer E Novosad
(74) *Attorney, Agent, or Firm* — Kenneth A. Roddy

(57) ABSTRACT

A stand for holding and storing clothing accessories, such as neckties, belts and footwear in an easily seen accessible position has an elongate freestanding generally rectangular upright frame, a flat planar horizontal platform or shelf at a lower end thereof for holding and storing shoes and other footwear; a second flat planar platform or shelf disposed at an angle above the lower platform or shelf also for holding and storing shoes and other footwear, a tie rack at a top end of the frame for holding and supporting a plurality of neckties in laterally adjacent relation in a plurality of rows at various heights, and a plurality of hooks mounted on outer facing sides of the frame in parallel spaced relation at various heights for holding and storing a plurality of belts supported thereon by hooking their buckles on the hooks.

2 Claims, 2 Drawing Sheets

STAND FOR HOLDING CLOTHING ACCESSORIES

BACKGROUND OF THE INVENTION

1. Field of the Invention

This invention relates generally to racks and stands for holding clothing accessories, and more particularly to a free-standing upright stand for holding neckties, belts, footwear, and the like.

2. Background Art

It is common to store a person's shoes and clothing items in a closet. Typically, shoes and footwear are stored on the closet floor or on a shelf at the bottom of the closet. Accessory items such as neckties and belts are also stored on short outwardly extending fingers of a small tie rack mounted in the closet or on a closet door.

Often, however, the closets become full and available storage space becomes limited, particularly when more than one person is using them. As the number of pairs of shoes and footwear increases, the amount of space allocated for them decreases. Similarly, the accumulated neckties draped over the short outwardly extending fingers of the tie rack often get stored one draped over or in front of the other, and belts supported thereon often get stored placed one in front of the other. Neckties and belts at the front interfere with removal of ties behind them, and often obstruct the vision so that selections cannot be made without removing a number of neckties and/or belts then replacing all but the one that is selected.

There are several patents directed toward various racks and stands for holding clothing accessories such as neckties, belts, footwear and other articles.

Brown, U.S. Pat. No. 5,542,758 discloses a combination wardrobe for storing trousers, shoes, shirts, belts and ties which is rotatable about a base and is adjustable to accommodate different numbers and sizes of shoes.

Frank, U.S. Pat. No. 6,102,216 discloses an attire organizer for storing both men's and women's shoes which includes a base panel, normally resting on a horizontal surface, two side panels joined by a joining panel, and a stack of shelf panels supported by either grooves or studs in the side panels. Support by studs permits selection of the angle of the shelf panels with the horizontal plane. Blocks removably secured on the outside surface of either side panel have an array of pegs. With the blocks oriented in one position, the pegs are used for hanging shoes with high heels; oriented in another position, the pegs are retracted to permit convenient storage of the rack. A tie panel is removably mounted by hinges on an outside surface of a side panel and has a tie bar on an inside surface so that the tie panel may be closed against the side panel to secure the ties when required or the tie panel may be swung back to provide accessibility to the ties.

McNab, U.S. Pat. No. 6,749,073 discloses a utility rack for organizing and storing a variety of clothing and accessory items commonly worn and used by law enforcement personnel. The rack includes several apparel supports and accessory supports, including a shoe-rack, radio support, microphone mount, apparel hook, hat-rack, utility belt hanger, vest hanger, and storage box all carried on an elongated post affixed to a base with adjustable footing for leveling the rack. The apparel supports and accessory supports are disposed at various levels along the height of the post for organizing the clothing and accessory items in a functional arrangement generally related to the manner in which the items are usually donned and removed.

Phillips, U.S. Pat. No. 6,991,118 discloses an accessory holding device for holding a plurality of accessory devices, such as hair clips, bows, barrettes, ties, and other hair accessories; as well as various items of jewelry. Internal attachment members hold clip type devices, while various posts, suspension devices, flexible attachment members, drawers, and retainers are provided to accommodate a wide array of items. The device may be relatively open, formed only with a base and sides, or may be enclosed with top, back, and face plates, in differing embodiments. The device may be freestanding, and may have suction grips to enhance adhesion to various surfaces. It may also be provided with a mounting device so that the entire device may be hung on a wall, back of a door, or other surface. The device may have mirrors on various surfaces and may be fitted with an interior light.

The present invention is distinguished over the prior art in general, and these patents in particular by a stand for holding and storing clothing accessories, such as neckties, belts and footwear in an easily seen accessible position has an elongate freestanding generally rectangular upright frame, a flat planar horizontal platform or shelf at a lower end thereof for holding and storing shoes and other footwear; a second flat planar platform or shelf disposed at an angle above the lower platform or shelf also for holding and storing shoes and other footwear, a tie rack at a top end of the frame for holding and supporting a plurality of neckties in laterally adjacent relation in a plurality of rows at various heights, and a plurality of hooks mounted on outer facing sides of the frame in parallel spaced relation at various heights for holding and storing a plurality of belts supported thereon by hooking their buckles on the hooks.

SUMMARY OF THE INVENTION

It is therefore an object of the present invention to provide a freestanding upright stand for holding and storing clothing accessories such as neckties, belts and footwear that is of improved capacity and is easy to use.

It is another object of this invention to provide a freestanding upright stand for holding and storing clothing accessories that has vertically spaced platforms for storing a plurality of pairs of shoes and other footwear in an easily seen and accessible position.

Another object of this invention is to provide a freestanding upright stand for holding and storing clothing accessories that has a tie rack disposed at an elevated position that allows a large number of neckties to be supported thereon in laterally adjacent relation in a plurality of rows at various heights for easy access and increased visibility for making selections.

Another object of this invention is to provide a freestanding upright stand for holding and storing clothing accessories that has a plurality of hook members on lateral sides disposed at an elevated position that allows a large number of belts to be supported thereon in laterally adjacent relation at various heights for easy access and increased visibility for making selections.

A further object of this invention is to provide a freestanding upright stand for holding and storing clothing accessories that is attractive in appearance and may be placed in a person's bedroom and used as a freestanding piece of furniture for storing clothing accessories, or it may placed in a closet.

A still further object of this invention is to provide a free-standing upright stand for holding and storing clothing accessories that is simple in construction, inexpensive to manufacture and long lasting in use.

Other objects of the invention will become apparent from time to time throughout the specification and claims as hereinafter related.

The above noted objects and other objects of the invention are accomplished by a stand for holding and storing clothing accessories, such as neckties, belts and footwear in an easily seen accessible position has an elongate freestanding generally rectangular upright frame, a flat planar horizontal platform or shelf at a lower end thereof for holding and storing shoes and other footwear; a second flat planar platform or shelf disposed at an angle above the lower platform or shelf also for holding and storing shoes and other footwear, a tie rack at a top end of the frame for holding and supporting a plurality of neckties in laterally adjacent relation in a plurality of rows at various heights, and a plurality of hooks mounted on outer facing sides of the frame in parallel spaced relation at various heights for holding and storing a plurality of belts supported thereon by hooking their buckles on the hooks.

DESCRIPTION OF THE PREFERRED EMBODIMENT

Figure 1:
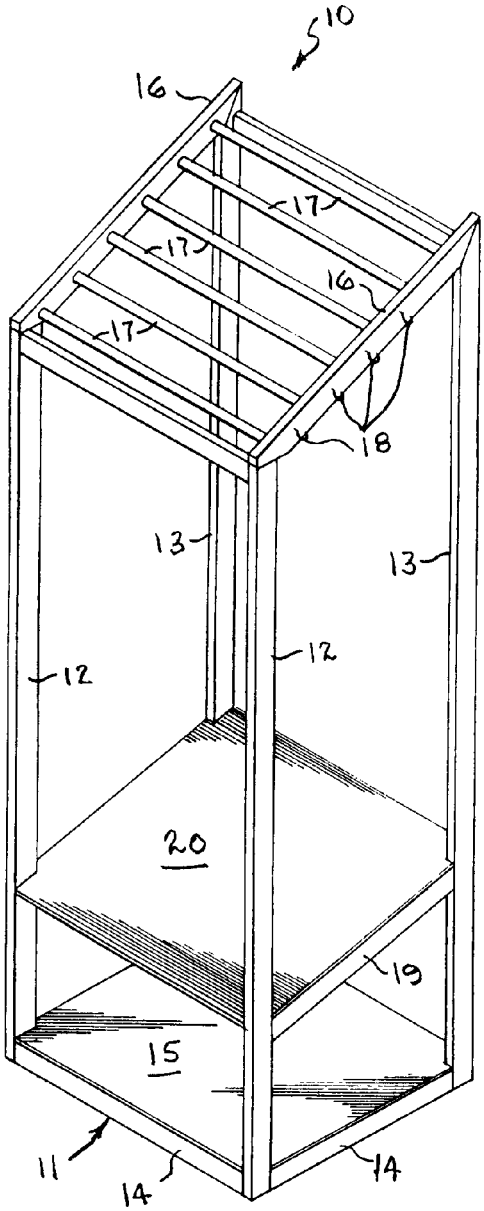
FIG. 1 is an isometric view of the stand for holding clothing accessories in accordance with the present invention, shown from the front, top and one side.
Figure 2:
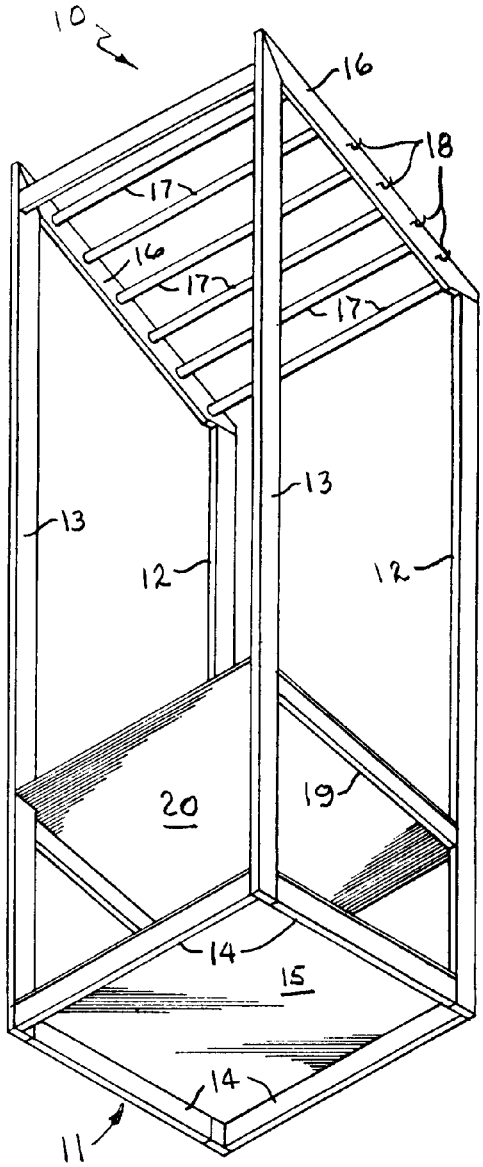
FIG. 2 is an isometric view of the stand, shown from the back, bottom and side opposite that shown in FIG. 1.
Figure 3:
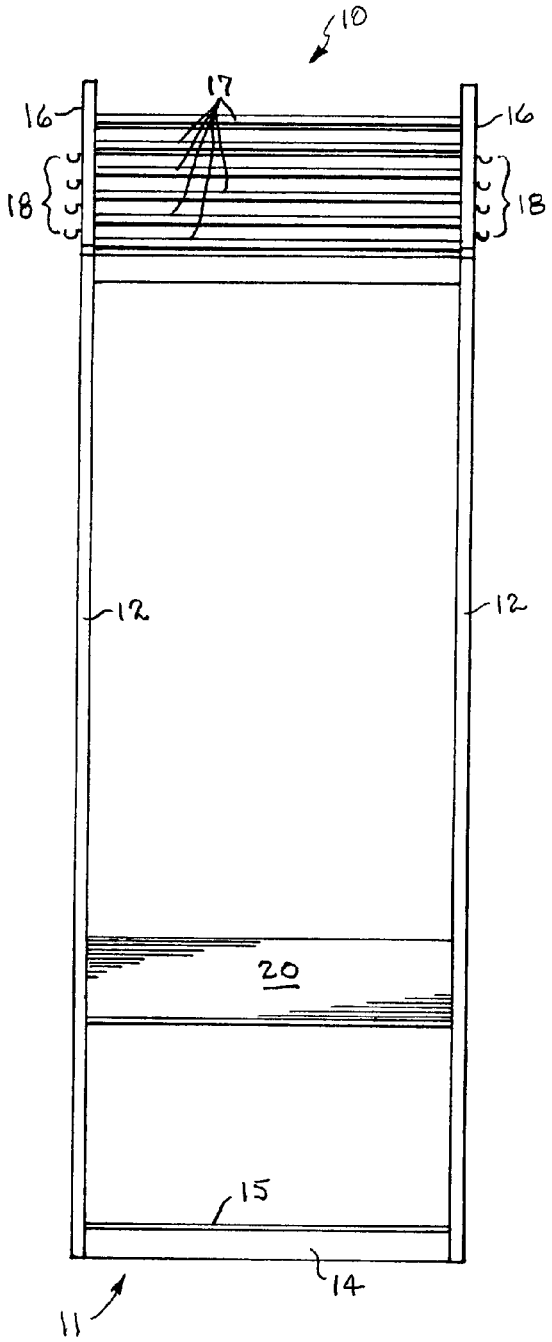
FIG. 3 is a front elevation view of the stand.
Figure 4:
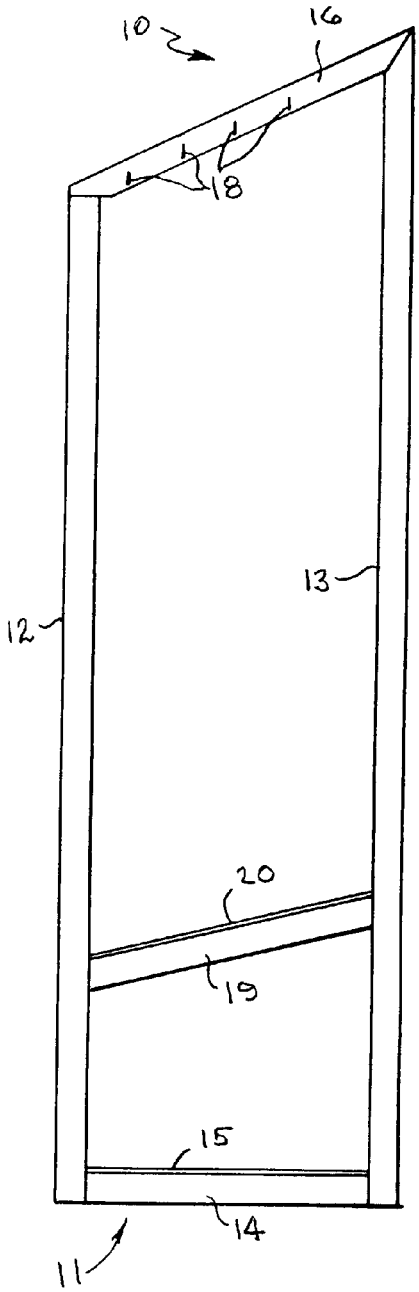
FIG. 4 is a side elevation view of the stand.

Referring to the drawings by numerals of reference, there is shown in FIGS. 1 through 4, a preferred stand 10 for holding clothing accessories, such as neckties, belts and footwear. The stand 10 has an elongate freestanding generally rectangular upright frame 11 formed of wood or other suitable rigid materials.

The frame 11 includes a front pair of elongate rectangular shorter vertical members 12 disposed in laterally spaced relation, and a rear pair of elongate rectangular longer vertical members 13 disposed in laterally spaced relation and parallel spaced relation relative to the front pair. The shorter vertical members 12 and longer vertical members 13 are joined together at their bottom ends by rectangular cross members 14 secured horizontally therebetween to form a base supported on a floor surface.

A flat planar bottom platform or shelf 15 having notched corners is secured to the top of the cross members 14 with the front and rear vertical members 12 and 13 received in its notched corners so as to reside transversely and horizontally therebetween. The bottom platform or shelf 15 serves as a horizontal surface for holding and storing shoes and other footwear.

The top end of each front shorter vertical member 12 is joined to the top end of a respective rear longer vertical member 13 by a respective rectangular top lateral side member 16 secured thereto to extend angularly upward and rearward between the front and rear vertical members.

A plurality of rods 17 are secured at opposed ends to the top lateral side member 16 to extend transversely therebetween in parallel spaced relation and along a plane extending angularly upward and rearward between the front and rear vertical members 12 and 13. The rods 17 form a tie rack for receiving and holding a plurality of neckties.

A plurality of hooks 18 are mounted on the outer facing sides of the top lateral side members 16 in parallel spaced relation along a plane extending angularly upward and rearward between the front and rear vertical members 12 and 13 for holding and storing a plurality of belts supported thereon by hooking their buckles on the hooks.

A pair of rectangular intermediate lateral side member 19 disposed a distance above the bottom platform or shelf 15 are each secured to a respective front shorter vertical member 12 and rear longer vertical member 13 to extend angularly upward and rearward between the front and rear vertical members.

A flat planar intermediate platform or shelf 20 having notched corners is secured to the top of the intermediate lateral side members 19 with the front and rear vertical members 12 and 13 received in its notched corners so as to reside transversely and angularly upward and rearward therebetween. The intermediate platform or shelf 20 serves as an angled surface for holding and storing shoes and other footwear.

The stand 10 is attractive in appearance and may be placed in a person's bedroom and used as a freestanding piece of furniture for storing clothing accessories, or it may be placed in a closet to provides additional storage capability an a small amount of space.

While this invention has been described fully and completely with special emphasis upon a preferred embodiment, it should be understood that within the scope of the appended claims the invention may be practiced otherwise than as specifically described herein.

The invention claimed is:

1. A clothing accessory stand for holding and storing neckties, belts and footwear, comprising:

an elongate freestanding generally rectangular upright frame of wooden construction having a front pair of elongate rectangular shorter vertical members disposed in laterally spaced relation, a rear pair of elongate rectangular longer vertical members disposed in laterally spaced relation and parallel spaced relation relative to said front pair, said shorter vertical members and said longer vertical members joined together at their bottom ends by rectangular cross members secured horizontally therebetween to form a generally rectangular base for supporting said frame in a vertical position on a floor surface;

a flat planar bottom platform or shelf secured to a top surface of said cross members forming said base so as to reside transversely and horizontally between a lower portion of said shorter vertical members and said longer vertical members for holding and storing shoes and other footwear;

a pair of rectangular top lateral side members each secured to the top ends of a respective said front shorter vertical member and rear longer vertical member to extend angularly upward and rearward therebetween, and a plurality of rods secured at opposed ends to said top lateral side members to extend transversely therebetween in parallel spaced relation and along a plane extending angularly upward and rearward between said front vertical members and said rear vertical members to define a tie rack at a top end of said frame for holding and supporting a plurality of neckties in laterally adjacent relation in a plurality of rows at various heights;

a pair of rectangular intermediate lateral side members disposed a distance above said bottom platform or shelf, each secured to a respective said front shorter vertical member and rear longer vertical member to extend angularly upward and rearward between said front and rear vertical members; and a flat planar intermediate platform or shelf secured to a top surface of said intermediate lateral side members so as to reside transversely and angularly upward and rearward between said front shorter members and said rear vertical members at a location between said bottom platform or shelf and said tie rack for holding and storing shoes and other footwear in an easily accessible position.

2. The stand according to claim 1, further comprising:

a plurality of hooks mounted on outer facing sides of said top lateral side members in parallel spaced relation along a plane extending angularly upward and rearward between said front and rear vertical members for holding and storing a plurality of belts in laterally adjacent relation at various heights, the belts supported thereon by hooking their buckles on the hooks.

* * * * *